US007526827B1

(12) United States Patent
Bitterman

(10) Patent No.: US 7,526,827 B1
(45) Date of Patent: May 5, 2009

(54) DRAIN PIPE CLEANING APPARATUS

(76) Inventor: Edward L. Bitterman, P.O. Box 391, Herber, UT (US) 84032

( * ) Notice: Subject to any disclaimer, the term of this patent is extended or adjusted under 35 U.S.C. 154(b) by 0 days.

(21) Appl. No.: 12/061,828

(22) Filed: Apr. 3, 2008

(51) Int. Cl.
*B08B 9/04* (2006.01)

(52) U.S. Cl. ..... 15/104.12; 15/104.09; 15/104.14; 15/104.31

(58) Field of Classification Search ..... 15/104.09, 15/104.12, 104.14, 104.31
See application file for complete search history.

(56) References Cited

U.S. PATENT DOCUMENTS

| | | | | | |
|---|---|---|---|---|---|
| 608,418 | A | * | 8/1898 | Bradley | 15/104.12 |
| 1,132,691 | A | * | 3/1915 | Sieben | 15/104.12 |
| 1,181,616 | A | * | 5/1916 | Sandblom | 15/104.14 |
| 1,549,761 | A | * | 8/1925 | Fuchs et al. | 15/104.12 |
| 2,175,406 | A | * | 10/1939 | Osborn | 15/104.14 |
| 2,181,306 | A | * | 11/1939 | Osborn | 15/104.14 |
| 2,838,779 | A | * | 6/1958 | Brydges et al. | 15/104.12 |
| 3,449,783 | A | | 6/1969 | Kirschke | |
| 3,740,785 | A | | 6/1973 | Latall | |
| 4,516,286 | A | | 5/1985 | Crane | |
| D287,654 | S | | 1/1987 | Boelens | |
| 4,766,631 | A | | 8/1988 | Crane et al. | |
| 5,379,476 | A | | 1/1995 | Salecker | |
| 2005/0028306 | A1 | | 2/2005 | Bergstrom | |

* cited by examiner

*Primary Examiner*—Mark Spisich

(57) ABSTRACT

A drain pipe cleaning apparatus includes a drive apparatus that includes a housing having a front end, a back end and a peripheral wall extending between the front and back ends. A drive shaft extends outwardly of the front end of the housing. The drive shaft is rotated about its axis when the drive apparatus is actuated. A pair of tethers is provided. Each of the tethers is attached to the drive shaft and extends to opposite directions with respect to each other. Each of a pair of cleaning members is attached to one of the tethers opposite of the drive shaft. The cleaning members scrape an inside surface of a pipe when the drive shaft is rotated.

7 Claims, 5 Drawing Sheets

DRAIN PIPE CLEANING APPARATUS

BACKGROUND OF THE INVENTION

Field of the Invention

The present invention relates to pipe cleaning devices and more particularly pertains to a new pipe cleaning device for removing the buildup on and cleaning an inner surface of a drain pipe.

SUMMARY OF THE INVENTION

The present invention meets the objectives presented above by generally comprising a drive apparatus that includes a housing having a front end, a back end and a peripheral wall extending between the front and back ends. A drive shaft extends outwardly of the front end of the housing. The drive shaft is rotated about its axis when the drive apparatus is actuated. A pair of tethers is provided. Each of the tethers is attached to the drive shaft and extends in opposite directions with respect to each other. Each of a pair of cleaning members is attached to one of the tethers opposite of the drive shaft. The cleaning members scrape an inside surface of a pipe when the drive shaft is rotated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended herein.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
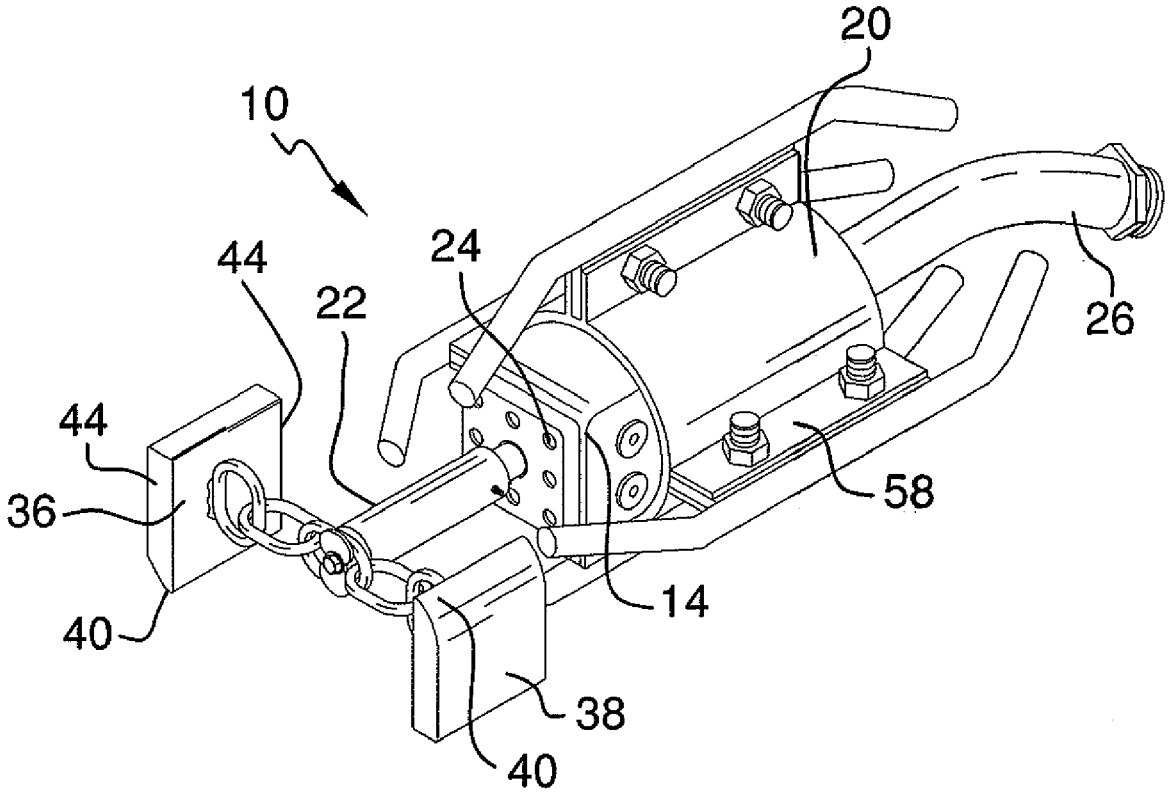
FIG. 1 is a perspective view of a drain pipe cleaning apparatus according to the present invention.

With reference now to the drawings, and in particular to FIGS. 1 through 7 thereof, a new pipe cleaning device embodying the principles and concepts of the present invention and generally designated by the reference numeral 10 will be described.

As best illustrated in FIGS. 1 through 7, the drain pipe cleaning apparatus 10 generally comprises a water powered drive apparatus 12. The drive apparatus 12 includes a housing 14 that has a front end 16, a back end 18 and a peripheral wall 20 extending between the front 16 and back 18 ends. A drive shaft 22 extends outwardly of the front end 16 of the housing 14. The drive shaft 22 is rotated about its axis when water is delivered under pressure to the drive apparatus 12. The drive apparatus 12 is conventional and may include an internal impeller that rotates the drive shaft 22 when water is forced into the drive apparatus 12 and exits though outlets 24 in the housing 14. An inlet conduit 26 is fluidly coupled to the drive apparatus 12 and extends outward of the back end 18. The inlet conduit 26 has a threaded end 28. A water conduit 30 is fluidly couplable to the threaded end 28 to supply water to the drive apparatus 12.

Figure 2:
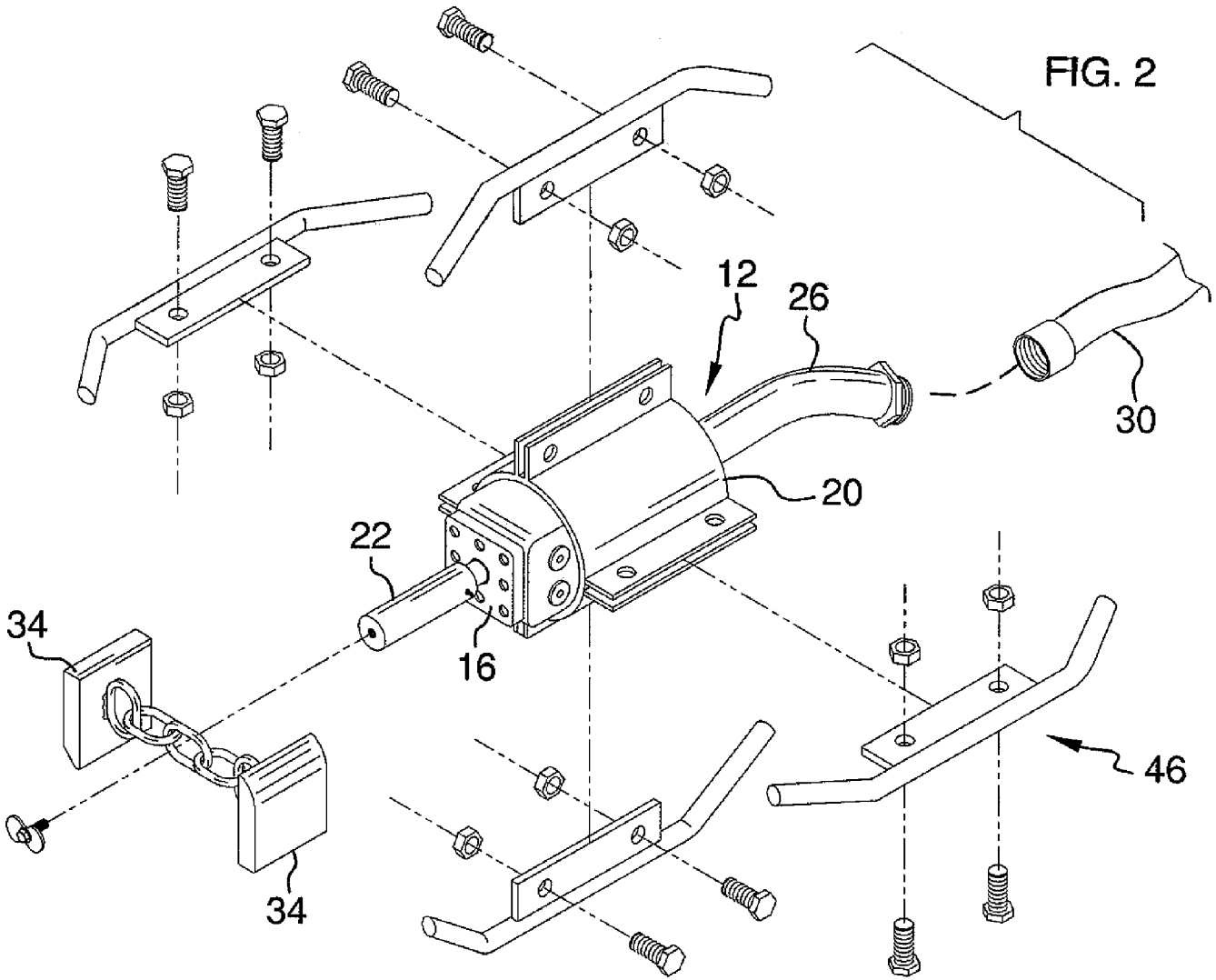
FIG. 2 is an expanded view of the present invention.
Figure 3:
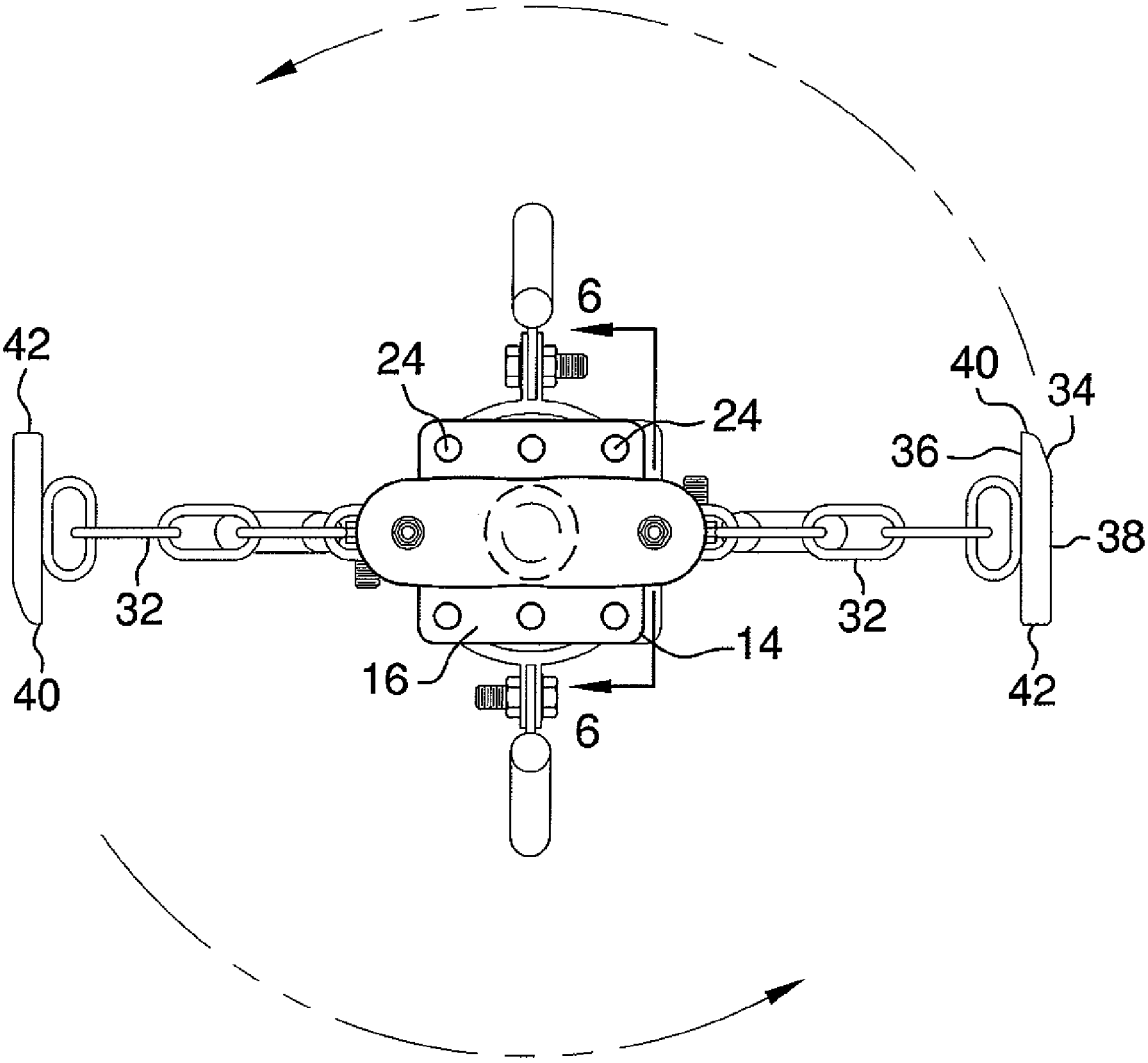
FIG. 3 is a front view of the present invention.
Figure 4:
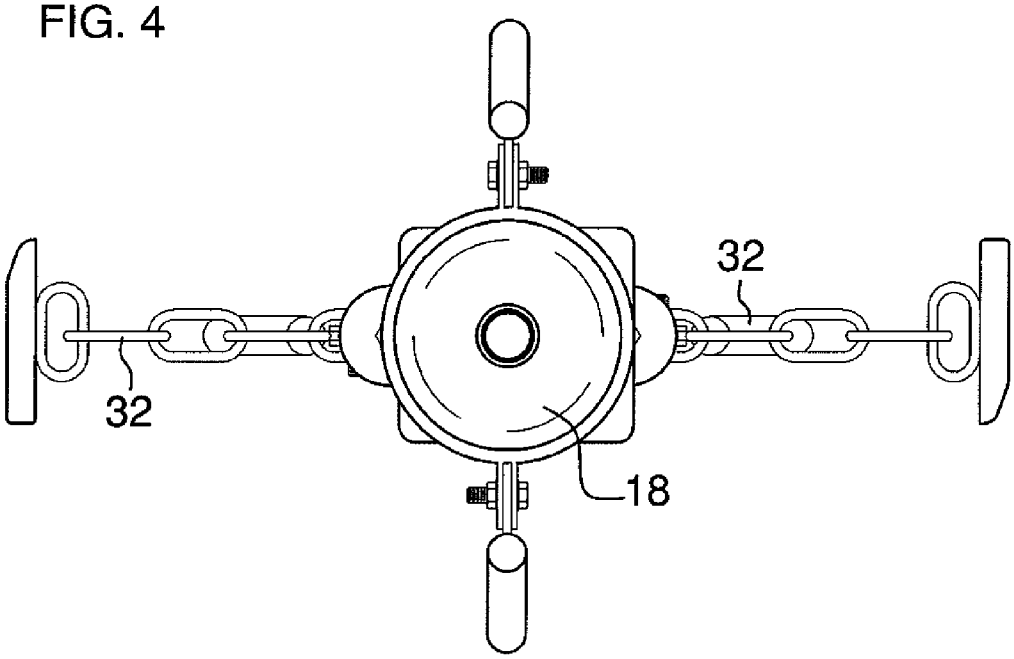
FIG. 4 is a rear view of the present invention.
Figure 5:
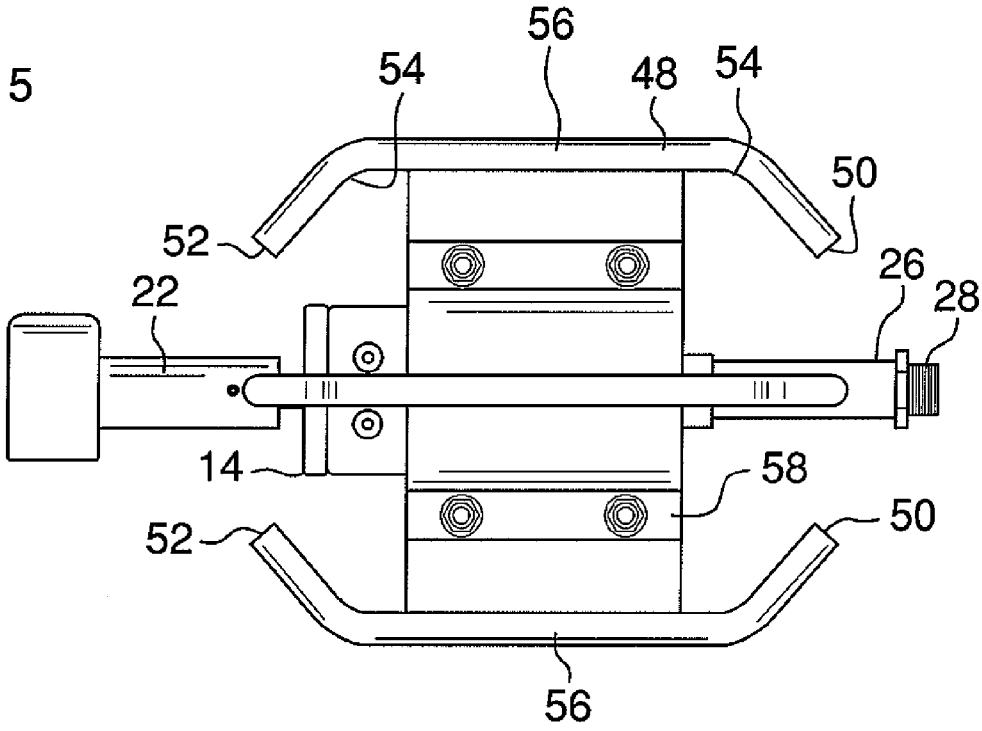
FIG. 5 is a side view of the present invention.
Figure 6:
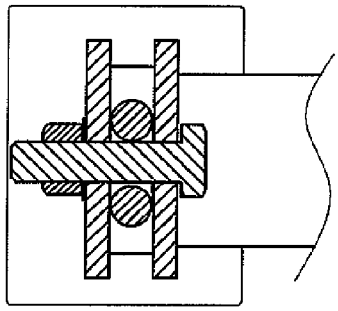
FIG. 6 is a cross-sectional view taken along line 6-6 of FIG. 3 of the present invention.
Figure 7:
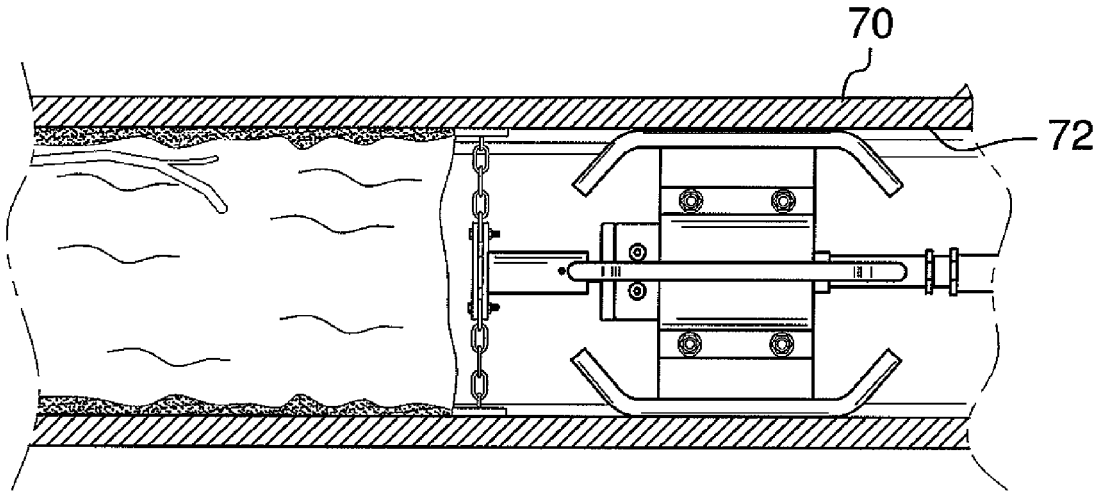
FIG. 7 is a side in-use view of the present invention.

A pair of tethers 32 is provided. Each of the tethers 32 is attached to the drive shaft 22 and extends in opposite directions with respect to each other. The tethers 32 may be comprised of a chain material. A pair of cleaning members 34 is also provided. Each of the tethers 32 has one of the cleaning members 34 attached thereto opposite of the drive shaft 22. The cleaning members 34 scrape an inside surface 72 of a pipe 70 when the drive shaft 22 is rotated. Each of the cleaning members 34 comprises a plate that has a first side 36, a second side 38, a leading edge 40, a back edge 42 and a pair of lateral edges 44. The tethers 32 are attached to the first sides 36. The leading edges 40 lead the cleaning members 34 when the drive shaft 22 is rotated. The leading edges 40 are angled back from the first sides 36 to a corresponding one of the second sides 38. As shown in FIG. 2, the two tethers 32 may be joined together.

A plurality of skids 46 is attached to the housing 14 and each is spaced from the peripheral wall 20. Each of the skids 46 includes an elongated member 48 that has a first end 50 and a second end 52. The elongated member 48 has a pair of bends 54 therein to angle each of the first 50 and second 52 ends upwardly from a central portion 56 of the elongated member 48. A connector 58 is attached to the central portion 56 and connects the elongated member 48 to the housing 14. The first 50 and second 52 ends are angled toward the housing 14 and the central portion 56 is oriented parallel to the drive shaft 22. The skids 46 are equally spaced from each other and the plurality of skids 46 may include four skids as shown in FIG. 2.

In use, the drive apparatus 12 is placed in a pipe 70 and a source of pressurized water is fluidly coupled to the inlet conduit 26. The pressurized water drives the rotation of the drive shaft 22 which causes the cleaning members 34 to extend outwardly from the drive shaft 22 and abut the inner surface 72 of the pipe 70. As the cleaning members 34 abut the inner surface 72, they remove any material positioned on the inner surface 72. The drive apparatus 12 can be pushed or pulled through the pipe 70 while the skids 46 allow the drive apparatus 12 to easily move along the pipe 70.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

I claim:

1. A pipe cleaning assembly comprising:

a drive apparatus including a housing having a front side, a back end and a peripheral wall extending between said front and back ends, a drive shaft extending outwardly of said front end of said housing, said drive shaft being rotated about its axis when said drive apparatus is actuated;

a pair of tethers, each of said tethers being attached to said drive shaft and extending in opposite directions with respect to each other; and a pair of cleaning members, each of said tethers having one of said cleaning members attached thereto opposite of said drive shaft, said cleaning members scraping an inside surface of a pipe when said drive shaft is rotated, each of said cleaning members comprising a plate having a first side, a second side, a leading edge, a back edge and a pair of lateral edges, said tethers being attached to said first sides, said leading edges leading said cleaning members when said drive shaft is rotated, said leading edges being angled back from said first sides to a corresponding one of said second sides, said plates being attached to the respective tether such that the plane defined by each plate is oriented perpendicular to the extended tether when the drive shaft is rotated.

2. The assembly according to claim 1, wherein said drive apparatus is a water powered drive apparatus, said drive shaft being rotated about its axis when water is delivered under pressure to said drive apparatus, an inlet conduit being fluidly coupled to said drive apparatus and extending outward of said back end, said inlet conduit having a threaded end, a water conduit being fluidly couplable to said threaded end to supply water to said drive apparatus.

3. The assembly according to claim 1, further including a plurality of skids being attached to said housing and being spaced from said peripheral wall.

4. The assembly according to claim 3, wherein each of said skids includes:

an elongated member having a first end and a second end, said elongated member having a pair of bonds therein to angle each of said first and second ends upwardly from a central portion of said elongated member; and a connector being attached to said central portion and connecting said elongated member to said housing, said first and second ends being angled toward said housing, said central portion being oriented parallel to said drive shaft.

5. The assembly according to claim 4, wherein said skids are equally spaced from each other.

6. The assembly according to claim 5, wherein said plurality of skids is four skids.

7. A pipe cleaning assembly comprising:

a water powdered drive apparatus, said drive apparatus including a housing having a front end, a back end and a peripheral wall extending between said front and back ends, a drive shaft extending outwardly of said front end of said housing, said drive shaft being rotated about its axis when water is delivered under pressure to said drive apparatus;

an inlet conduit being fluidly coupled to said drive apparatus and extending outward of said back end, said inlet conduit having a threaded end, a water conduit being fluidly couplable to said threaded end to supply water to said drive apparatus;

a pair of tethers, each of said tethers being attached to said drive shaft and extending in opposite directions with respect to each other;

a pair of cleaning members, each of said tethers being one of said cleaning members attached thereto opposite of said drive shaft, said cleaning members scraping an inside surface of a pipe when said drive shaft is rotated, each of said cleaning members comprising a plate having a first side, a second side, a leading edge, a back edge and a pair of lateral edges, said tethers being attached to said first side, said leading edges leading said cleaning members when said drive shaft is rotated, said leading edges being angled back from said first sides to a corresponding one of said second sides, said plates being attached to the respective tether such that the plane defined by each plate is oriented perpendicular to the extended tether when the drive shaft is rotated;

a plurality of skids being attached to said housing and being spaced from said peripheral wall, each of said skids including:

an elongated member having a first end and a second end, said elongated member having a pair of bends therein to angle each of said first and second ends upwardly from a central portion of said elongated member;

a connector being attached to said central portion and connecting said elongated member to said housing, said first and second ends being angled toward said housing, said central portion being oriented parallel to said drive shaft;

said skids being equally spaced from each other, said plurality of skids being four skids.

* * * * *